US005338129A

United States Patent [19]

Oden

[11] Patent Number: 5,338,129

[45] Date of Patent: Aug. 16, 1994

[54] TRAFFIC DELINEATION FOAM SYSTEM AND METHOD

[76] Inventor: Alan D. Oden, Rte. 2, Box 346A, Morgantown, Ind. 46160

[21] Appl. No.: 959,074

[22] Filed: Oct. 13, 1992

[51] Int. Cl.[5] ..... E01F 9/04

[52] U.S. Cl. ..... 404/9; 404/12; 404/72; 116/63 C; 116/202

[58] Field of Search ..... 404/9, 10, 12, 72, 93, 404/94, 108, 111; 116/63 C, 63 P, 63 R, 202; 239/150, 170, 172

[56] References Cited

U.S. PATENT DOCUMENTS

| | | | |
|---|---|---|---|
| 2,719,505 | 10/1955 | Blumenthal | 116/63 C |
| 3,086,431 | 4/1963 | Perry, Jr. | 94/39 |
| 3,481,545 | 12/1969 | Cooke et al. | 111/33 |
| 3,871,557 | 3/1975 | Smrt | 239/150 X |
| 3,880,537 | 4/1975 | Harris et al. | 404/15 |
| 3,902,818 | 9/1975 | Boone | 404/10 |
| 3,916,816 | 11/1975 | Fitch | 116/63 P |
| 3,967,704 | 7/1976 | Ogden | 188/32 |
| 4,011,914 | 3/1977 | Elmer | 172/126 |
| 4,165,834 | 8/1979 | Pitchon et al. | 239/10 |
| 4,236,950 | 12/1980 | Eigenmann | 156/71 |
| 4,273,264 | 6/1981 | Legg | 222/162 |
| 4,373,670 | 2/1983 | Kilner | 239/172 |
| 4,541,947 | 9/1985 | Clark et al. | 169/46 X |
| 4,572,703 | 2/1986 | Moller | 404/94 |
| 4,626,127 | 12/1986 | May | 404/14 |
| 4,793,559 | 12/1988 | Marlek | 239/722 |
| 4,817,870 | 4/1989 | Dalton | 239/172 X |
| 4,943,008 | 7/1990 | Smrt | 239/150 X |
| 5,031,834 | 7/1991 | Simpson | 239/150 X |
| 5,052,854 | 10/1991 | Correa et al. | 404/94 |
| 5,059,061 | 10/1991 | Stenemann et al. | 404/94 X |
| 5,133,500 | 7/1992 | Simpson | 239/150 |
| 5,199,755 | 4/1993 | Gertz | 256/13.1 X |

OTHER PUBLICATIONS

RHS Foam Marker System Product Description.

*Primary Examiner*—Ramon S. Britts
*Assistant Examiner*—James A. Lisehora
*Attorney, Agent, or Firm*—Woodard, Emhardt, Naughton, Moriarty & McNett

[57] ABSTRACT

A method and apparatus for applying colored foam markers to road surfaces as a means of temporarily changing or outlining traffic patterns. In the preferred embodiment, dissoluble foam markers would be periodically deposited upon the road behind a work crew to alert motorists of a potential hazard ahead, in order to avoid any collisions between the motorist and the work crew. As the work crew would move up on the road, the foam markers would naturally dissipate and substantially disappear over a predetermined or a relatively short period of time so that the roadway automatically returned to its original traffic pattern when the work crew has left the area. Foam markers according to the present invention would enhance the safety of a work crew's operations and increase work output by freeing the work crew from the obligation of retrieving the markers after they are used.

4 Claims, 4 Drawing Sheets

TRAFFIC DELINEATION FOAM SYSTEM AND METHOD

BACKGROUND OF THE INVENTION

The present invention relates generally to a method and system for temporarily marking or altering traffic patterns for vehicles, and in particular to such a method and system which uses dissoluble markers that substantially disappear over a predetermined or a relatively short period of time.

During roadway maintenance operations, such as applying paint stripes to a roadway or filling cracks in the roadway, work crews normally move along the roadway at a steady but slow continuous pace, normally on the order of 5–15 miles per hour. During these operations, the work crew's trailing vehicle is normally a heavy truck that in essence acts as a barrier between tile work crew and cars or other vehicles approaching the work crew from the rear. Because the work crew is moving along the roadway at such a low speed, motorists often come upon the work crew unexpectedly and sometimes crash into the trailing heavy truck often resulting in death or serious injury.

In order to decrease the incidence of death and serious injury during such collisions, a device commonly referred to as a truck-mounted crash attenuator is attached to and extends away from the rear end of the trailing heavy truck. The crash attenuator is essentially a steel framework which is attached to the rear end of tile truck and extends approximately ten or more feet from the rear of the truck at about the grille level of an average car. When impacted, the crash attenuator collapses and decelerates the car to a stop over a significantly longer distance than if the motorist simply crashed into the rear of the trailing heavy truck. This elongated deceleration normally results in a destroyed crash attenuator and a damaged motor vehicle, but often spares the motorist from the potentially deadly impact of a relatively instantaneous stop. Nevertheless, even with the use of truck-mounted crash attenuators, motorists are often needlessly injured simply because they encounter the slowly moving roadway work crews unexpectedly without sufficient time to brake and avoid a collision. What is needed is an inexpensive way of alerting motorists that a slowly moving work crew is just ahead so that the motorist slows down before it is too late.

Foam marking systems have long been known and used in the farming industry. The most significant usage of foam markers in the farming industry relates primarily to the application of fertilizers to a field of crops. When applying fertilizers, it is desirable to evenly distribute the fertilizer over the area of the field but it is normally critical that no area of the field receive a double dose of fertilizer. In other words, each adjacent sweep over the field by the fertilizer vehicle must be contiguous but not overlapping the previous sweep so that no portion of the field receives a double dose of fertilizer. In order to avoid the double fertilizing problem, farmers attach a foam marker system, such as the RHS foam marker system Model No. MKR-5000-14, to the fertilizing apparatus. As the fertilizing vehicle travels along the field, globs of foam are dropped from the marker system onto the field at the extreme edge of the fertilizing sweep so that the farmer knows precisely where the fertilizer has and has not been applied. In each successive sweep of the field, the farmer uses the line of foam markers as a guide for preventing the successive fertilizer sweeps from overlapping one another.

The present invention comprises a method and system which utilizes foam marker systems which are similar in construction to the foam marker systems used in the farming industry. However, unlike the farming applications, the present invention contemplates use of foam markers to alert third parties to a potential road hazard or parking location for their vehicle rather than as a guide for the same person who laid down the markers as in the case for fertilizing applications.

SUMMARY OF THE INVENTION

A method of temporarily altering traffic patterns on a roadway according to one embodiment of the present invention comprises the step of depositing a plurality of dissoluble markers in a desired pattern on the roadway. The markers are formed from a material which dissipates and substantially disappears in a predetermined or a relatively short period of time so that the roadway automatically returns to its original traffic pattern. Thus, the markers remain viable only so long as they are needed, thereby relieving work crews from having to retrieve the markers after they are no longer needed.

A temporary traffic delineation system for a roadway according to another embodiment of the present invention comprises a vehicle. A means for continuously generating dissoluble traffic markers is carried by the vehicle. Also, a means for dropping the dissoluble traffic markers from the vehicle to form a predetermined pattern on the roadway is connected to the generating means. Finally, the markers are such that they dissipate and substantially disappear over a predetermined or a relatively short period of time.

One object of the present invention is to save lives.

Another object of the present invention is to decrease the incidence of collisions between motorists and roadway work crews.

Still another object of the present invention is to provide a naturally dissipating marking system which alerts motorists to a potential hazard.

Another object of the present invention is to provide an improved method of temporarily altering traffic patterns.

Other objects and advantages of the present invention will be apparent from the following description.

DESCRIPTION OF THE PREFERRED EMBODIMENT

Figure 1:
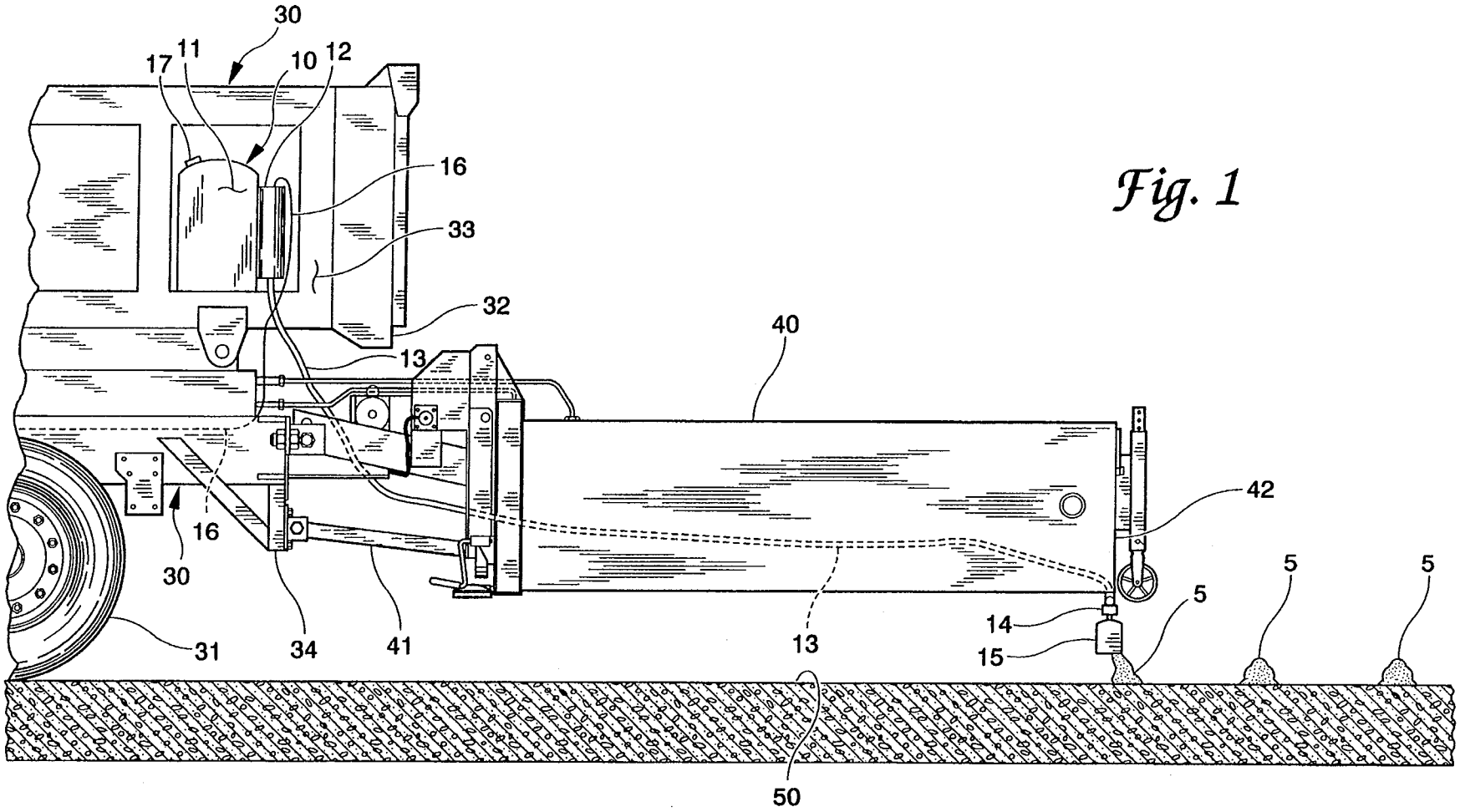
FIG. 1 is a side elevational view of a temporary traffic delineation system for a roadway according to the preferred embodiment of the present invention.

For the purposes of promoting an understanding of the principles of the invention, reference will now be made to the embodiments illustrated in the drawings and specific language will be used to describe the same.

It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, there is shown an ordinary heavy-duty truck 30 that is used by roadway work crews during maintenance and repair operations. Truck 30 includes several tires 31 which support the truck frame 34 and truck bed 32. Attached to the rear end of frame 34 via strut 41 is a crash attenuator 40. As discussed earlier, crash attenuator 40 extends rearwardly from the last truck in the line of the working crew so that the impact from any collision approaching from behind the work crew is substantially absorbed by the crash attenuator. Also attached to truck 30 is a foam marker system 10 which in this case is mounted to the truck bed 32 adjacent to side wall 33 as shown. It is to be understood that foam marker system 10 could be mounted on truck 30 at any convenient location.

Marker system 10 includes a reservoir 11 that holds a mixture of water and foam concentrate, and preferably has a capacity of at least 10 gallons or more depending on the volume needed. Reservoir 11 includes a filler cap 17 which allows foam marker system 10 to be refilled with water and foam concentrate when desired. Attached to reservoir 11 is an electronic foam generator and pump 12. Foam generator/pump 12 is preferably powered from the truck's electrical system and is controlled via control line 16 which has its other end connected to a switch located in the cab of the truck (not shown). This enables the driver of the vehicle to switch foam marker system 10 on and off, and control the rate at which it produces foam markers 5. A foam supply line 13 is attached to pump 12 and travels through crash attenuator 40 until terminating at a plurality of foam dispensers 15, which are located adjacent rear face 42 of crash attenuator 40.

Figure 2:
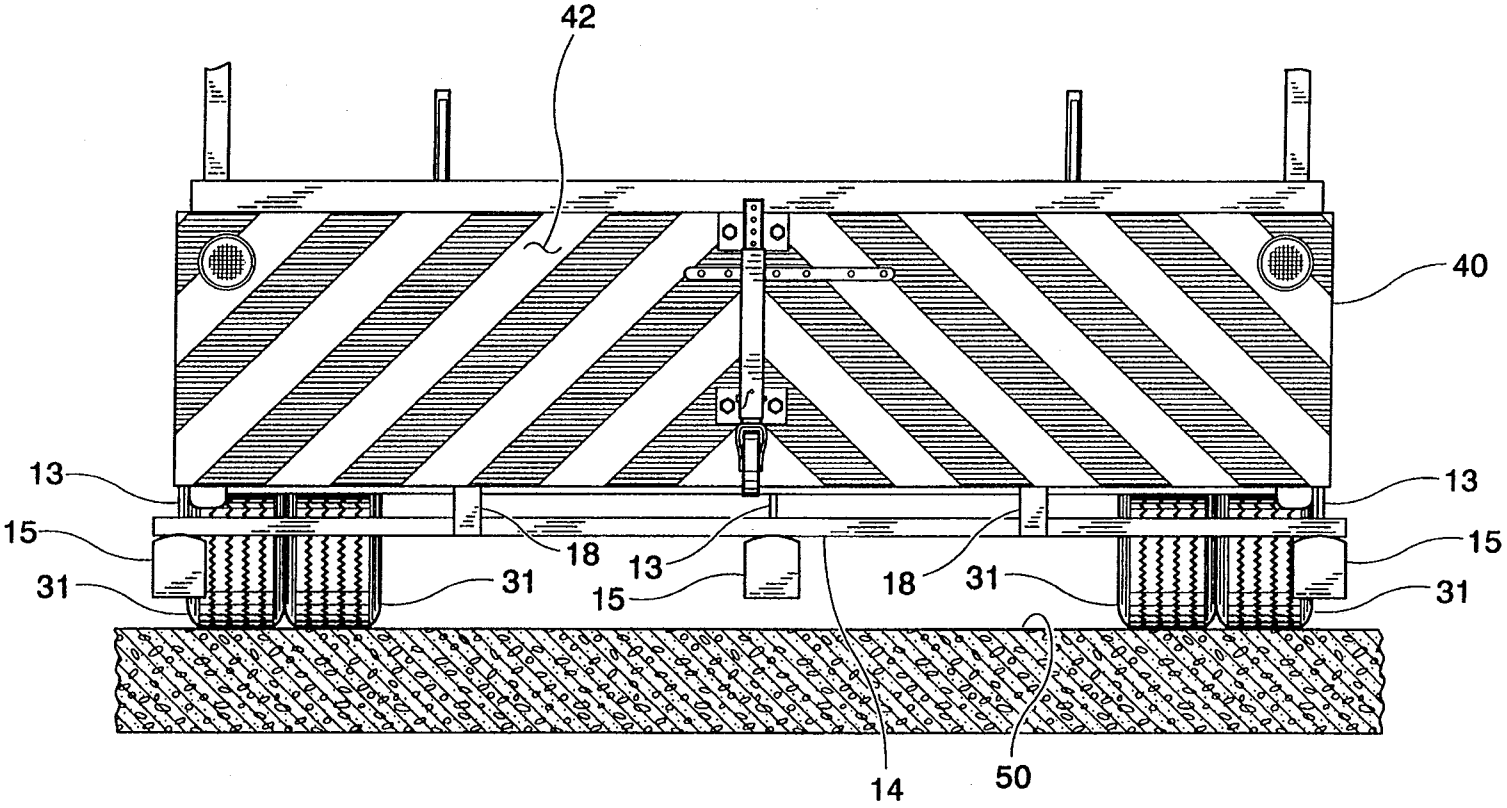
FIG. 2 is a partial rear elevational view of the system of FIG. 1.

As shown in FIG. 2, foam dispensers 15 are slidably attached to an elongated boom 14 which extends substantially the width of crash attenuator 40. Boom 14 is attached to crash attenuator 40 via a pair of brackets 18. It being understood that crash attenuator 40 is not a necessary element of the invention but instead merely establishes the preferred environment of the present invention. In other words, boom 14 could be attached directly to the rear of a truck or any other vehicle depending upon the desired use of the system. Foam dispensers 15 have the ability to slide laterally along boom 14 in order to enable one to control the precise pattern of foam markers 5 which are laid on the roadway 50. Foam supply line 13 includes a branching portion, which is not shown, so that a single supply line from foam pump 12 can provide foam to several foam dispensers 15 as illustrated.

Figure 3:
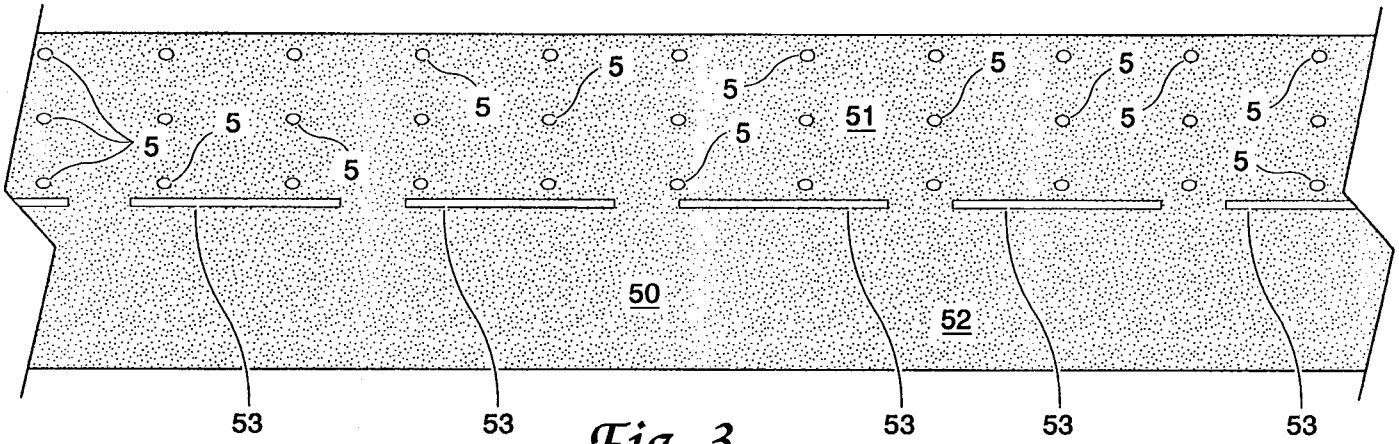
FIG. 3 is a top view of a roadway having a pattern of dissoluble markers applied in a pattern to one lane of the roadway.

As the work crew slowly moves along roadway 50, foam marker system 10 continuously produces foam markers 5 that periodically drop from foam dispensers 15 in a desired pattern, such as the pattern shown in FIG. 3. Foam markers 5 are preferably shaped as a cylinder, a cone or a frustaconical shape. FIG. 3 shows a top view of roadway 50 which includes a right lane 51 and a left lane 52. In this case, the pattern shown would be useful when a work crew is moving slowly along lane 51 to fill surface cracks therein. With respect to FIG. 3, the work crew would be situated outside the illustration to the left. Thus, a motorist traveling on lane 51 would encounter foam markers 5 and would be alerted to a potential hazard ahead of them on the roadway. In this way, foam markers 5 lessen the likelihood of a collision between the motorist and the slowly moving work crew.

Figure 4:
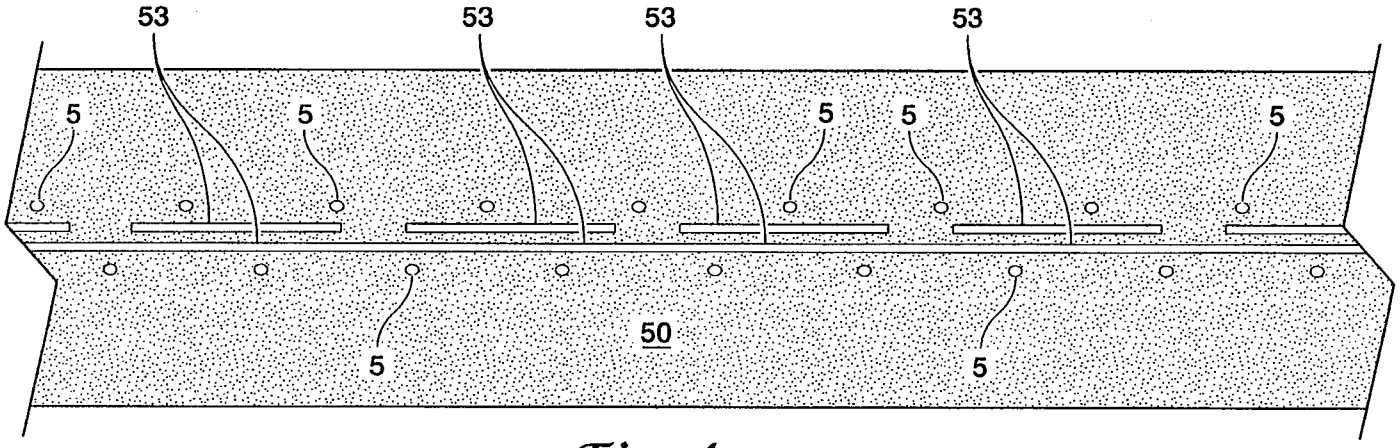
FIG. 4 is a top view of a roadway having a different pattern of dissoluble markers applied thereto.

FIG. 4 shows a different pattern for laying down foam markers 5 during a striping operation in which new stripes 53 have been painted upon roadway 50. In this application, foam markers 5 alert motorists that new centerlines 53 are currently being painted and also inform motorists as to the presence of wet paint. Thus, foam markers 5 alert motorists to a changed roadway condition (wet paint) as well as alert the motorists to use caution because a striping work crew is likely nearby. The alternating pattern shown in FIG. 4 can be produced by attaching solenoid operated doors at the openings in the base of foam dispensers 15. In this way, foam dispensers 15 could be alternately opened and closed to precisely control where and when foam markers 5 are dropped from the vehicle. The cavity within foam dispensers 15 fills with foam when the door is closed and the foam marker 5 is released when the door is opened. Depending upon the application, the solenoid operated doors could be manually or automatically controlled.

The foam markers 5 of the present invention preferably dissipate and substantially disappear from the roadway over a predetermined period of time or a relatively short period of time. The length of time in which a foam marker will remain visible and before it dissolves is controlled by the mixture of foam concentrate and water in reservoir 11, the bubble size of the individual bubbles of the foam and the outstanding weather conditions. It is to be understood that the foam markers 5 may also be made of any chemical composition that creates a marker that will substantially disappear over a predetermined period or relatively short period of time. By controlling such factors, foam markers 5 can be made to have a predetermined duration as short as several minutes up to several hours or more. Such control allows for the use of foam markers 5 that will stay viable at least as long as the work crew represents a hazard to motorists in a particular area, or the traffic pattern otherwise requires alteration. For example, the foam markers 5 can naturally dissipate by themselves after the work crew has moved on the order of one-quarter mile or more from the individual foam marker such that it is no longer needed. Apart from being naturally dissipatable, foam markers 5 could also be removed from the roadway simply by being hosed off with water after they have served their purpose. The dissoluble foam marker aspect of the present invention adds an element of safety to work crew operations as in permanent marking systems, such as traffic cones, but frees work crews to do other work instead of having to return and retrieve several permanent markers as is the case in the present state of the art. Thus, in addition to adding an element of safety, the present invention can increase the work output efficiency of the roadwork crew. In addition to the water and foam concentrate carried by reservoir 11, it is preferable to include a colored dye which will result in colored foam markers 5 that contrast with the roadway in order to make them easier to see. The dye could also include a fluorescent element to make foam markers 5 even more readily visible to motorists.

Figure 5:
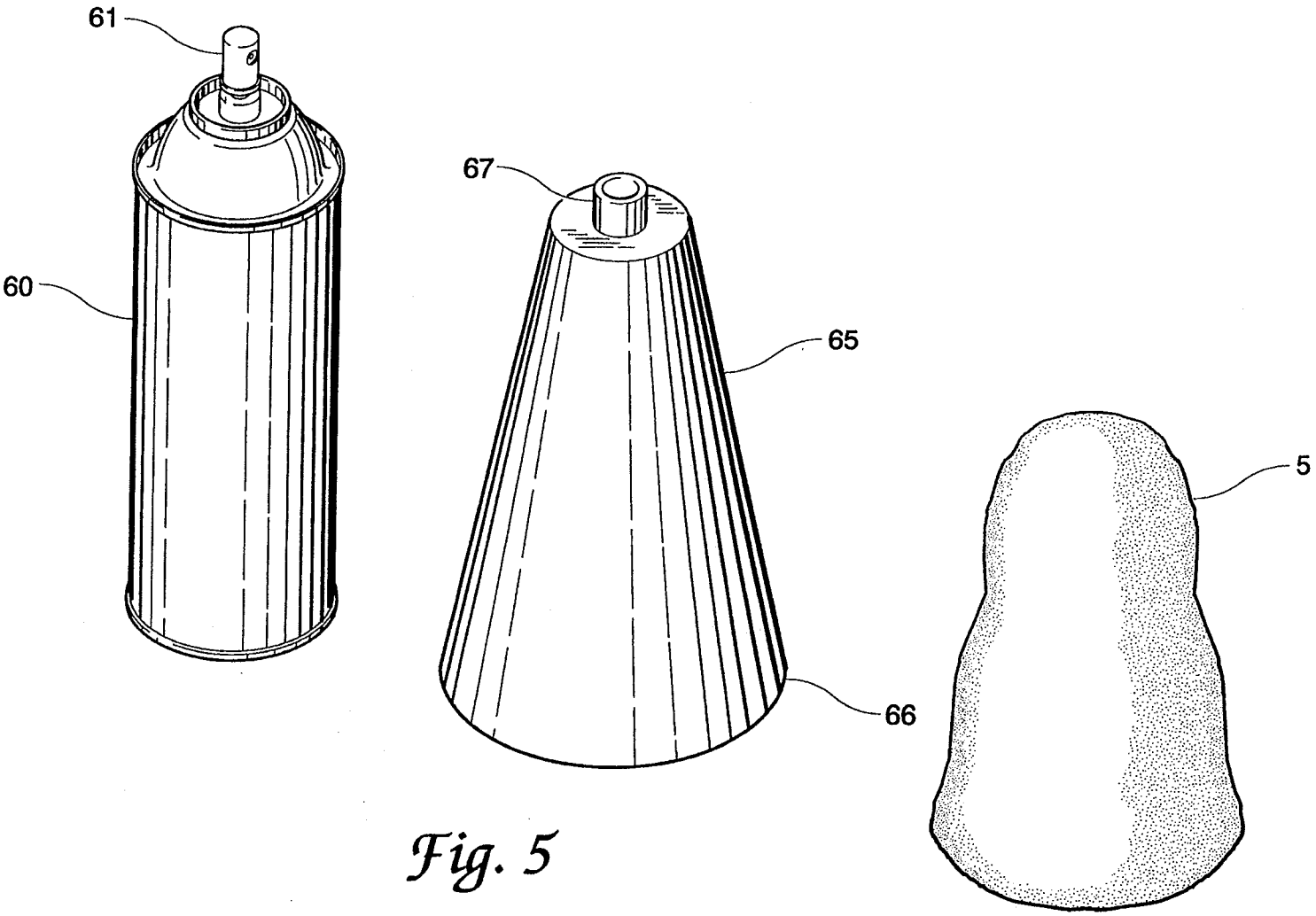
FIG. 5 is a schematic view of an alternate hand-held embodiment of the present invention.

In another application of the present invention, law enforcement officers, truckers and even ordinary motorists would carry a container, such as an aerosol can, which is filled with ready-to-use concentrated foam. In this application, the foam would be similar to shaving cream except it would preferably include a fluorescent dye therein. In this application, the law enforcement officer or other person could lay down a pattern of foam markers on the roadway to temporarily alter traffic patterns around a traffic accident or other hazard. Such a temporary foam marking system might be especially useful when gasoline has been leaked upon a road during an accident making the use of ordinary flares unsuitable and unsafe. This application of the invention includes an aerosol can of concentrated foam 60 with or without a foam mold, as illustrated in FIG. 5. Aerosol can 60 includes a foam concentrate such as shaving cream with a colored dye added and is dispersed from can 60 through nozzle 61. Also included is a frustaconically shaped mold 65 preferably made from a low stick plastic. In order to make foam marker 5, foam mold 65 is set upon the ground with base portion 66 resting thereon or immediately above the ground. One then fills foam mold 65 with foam from can 60 through opening 67 in the top of foam mold 65. After the foam mold 65 is filled, one lifts the foam mold and leaves the molded foam marker 5 in place and proceeds to make another foam marker 5 in whatever pattern is desired.

Apart from steering traffic around an accident, the foam marker-system illustrated in FIG. 5 would also be useful in such diverse applications as marking a temporary landing site for a helicopter or other rescue vehicle at an accident scene. Other applications include marking a temporary parking lot on a grass field for such things as sporting events, marking a temporary landing site for small aircraft.

Still another contemplated variation of the present invention includes making permanent foam markers at a site by utilizing a foam concentrate which cures into a relatively solid foam mass. This application would naturally utilize a foam mixture that would likely be based on a substance other than water. This application of the present invention would be useful in enabling construction crews to rapidly and inexpensively make relatively permanent traffic markers at a construction site. This application could be used with either the apparatus 10 shown in FIG. 1 or the foam marking apparatus shown in FIG. 5. Construction crews would simply fill a mold with an amount of foam, allow it to cure, and then remove the hardened foam marker and utilize it as desired.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A method of alerting third parties to a traffic hazard, desired traffic pattern or parking location, comprising the steps of:

(a) selecting a dissoluble marker which will dissipate and substantially disappear over a predetermined and relatively short period of time;

(b) determining one or more marker locations effective for depositing dissoluble markers to alert third parties to a traffic hazard, a desired traffic pattern or parking location; and subsequently (c) depositing said dissoluble markers in the determined marker locations to alert third parties to a traffic hazard, a desired traffic pattern or parking location.

2. The method of claim 1 wherein said dissoluble markers are made of foam.

3. The method of claim 2 wherein said foam includes a dye of a desired color.

4. The method of claim 3 wherein said dye is fluorescent.

* * * * *